United States Patent [19]

Rabus et al.

[11] 4,217,872

[45] Aug. 19, 1980

[54] MULTIPLE SPARK IGNITION SYSTEM FOR AN INTERNAL COMBUSTION ENGINE

[75] Inventors: Friedrich Rabus, Schwieberdingen; Günter Gräther, Pinache, both of Fed. Rep. of Germany

[73] Assignee: Robert Bosch GmbH, Stuttgart, Fed. Rep. of Germany

[21] Appl. No.: 776,738

[22] Filed: Mar. 11, 1977

[30] Foreign Application Priority Data

May 4, 1976 [DE] Fed. Rep. of Germany ..... 2619556

[51] Int. Cl.[3] ..... F02P 1/00

[52] U.S. Cl. ..... 123/596

[58] Field of Search ..... 123/148 E, 148 CB

[56] References Cited

U.S. PATENT DOCUMENTS

| | | | |
|---|---|---|---|
| 3,039,021 | 1/1962 | Chertoff et al. | 123/148 E |
| 3,253,185 | 5/1966 | Morrison | 123/148 E |
| 3,277,340 | 10/1966 | Jukes et al. | 123/148 E |
| 3,372,684 | 3/1968 | Gilbert | 123/148 E |
| 3,394,690 | 7/1968 | Bell | 123/148 E |
| 3,714,507 | 1/1973 | Schweitzer et al. | 123/148 CB |
| 3,882,840 | 5/1975 | Adamian et al. | 123/148 S |
| 3,892,219 | 7/1975 | Preiser et al. | 123/148 E |
| 3,906,919 | 9/1975 | Asik et al. | 123/148 CB |
| 3,923,029 | 12/1975 | Polo | 123/148 E |
| 3,926,165 | 12/1975 | Merrick | 123/148 E |
| 3,926,557 | 12/1975 | Callies et al. | 123/148 E |
| 3,934,570 | 1/1976 | Asik et al. | 123/148 CB |
| 3,976,043 | 8/1976 | Canup et al. | 123/148 E |
| 4;077,380 | 3/1978 | Canup | 123/148 E |
| 4,091,787 | 5/1978 | Frank | 123/148 E |
| 4,106,462 | 8/1978 | Hilldebrandt et al. | 123/148 E |

OTHER PUBLICATIONS

Guidebook of Electronic Circuits, (3/5/75), Markus, McGraw Hill Book Co., N.Y., p. 126.

*Primary Examiner*—S. A. Cangialosi

*Attorney, Agent, or Firm*—Frishauf, Holtz, Goodman & Woodward

[57] ABSTRACT

A frequency generator is enabled when an ignition event is to occur, to provide a sequence of current pulses to an ignition coil, so that multiple sparks will be commanded for any one single ignition event. To compensate for changes in operating parameters, particularly low-voltage condition of supply current, the frequency generator is controllable to change the pulse width, or the frequency thereof. To simply compensate for voltage variations, the frequency generator is a voltage controlled oscillator (VCO), controlled by the electrical supply network, typically the battery of a vehicle.

8 Claims, 3 Drawing Figures

MULTIPLE SPARK IGNITION SYSTEM FOR AN INTERNAL COMBUSTION ENGINE

Cross reference to related applications:

U.S. Ser. No. 776,739, filed Mar. 11, 1977, now U.S. Pat. No. 4,114,582, RABUS et al.

U.S. Ser. No. 776,735, filed Mar. 11, 1977, GRATHER et al U.S. Ser. No. 776,740, filed Mar. 11, 1977, Manger et al, now U.S. Pat. No. 4,112,890 all assigned to the assignee of the present application.

The present invention relates to an ignition system for an internal combustion engine, and more particularly to a system in which multiple sparks are generated for any one ignition event.

The ignition system for an internal combustion engine, and in the primary application of the present invention, an automotive-type internal combustion engine, an ignition coil is provided, the secondary of which is connected to a spark gap, typically to the spark plugs, of the engine. To provide for distribution, a distributor is interposed between the secondary of the spark plugs and the ignition coil. The primary of the ignition coil is connected through a controlled switch, for example a transistor, to a source of power. To provide for multiple ignition sparks at any one ignition event, that is, for ignition of any one cylinder, a frequency generator is provided to generate a series of pulses, or a pulse train, which pulses are applied to the ignition coil to generate a series or train of sparks across the spark gap thereof. The frequency generator in one type of system repetitively controls the switch, typically the transistor, in series with the ignition coil to provide for a train of switch operations, that is, a sequence of opening and closing connections of the switch, in order to generate the train of sparks at the spark plug. The spark train has the advantage over a single spark by providing for more complete combustion of the fuel-air mixture in the combustion chamber of the internal combustion (IC) engine. Unfortunately, the pulse train ignition system has a disadvantage: When the supply voltage for the ignition coil drops, for example during starting of the internal combustion engine and when a starter motor draws a substantial current, the closing time of the switch may not be long enough to store sufficient magnetic energy in the ignition coil, which results, upon opening of the switch, in an ignition voltage which is too low for proper ignition operation, that is, in a weak spark or, possibly, even no spark at the ignition coil.

It is an object of the present invention to provide a system in which a train of spark pulses is supplied and which reliably effects ignition, even though the supply voltage may drop.

Subject matter of the present invention: Briefly, the frequency generator providing the train of pulses to cause the ignition pulses is a controllable frequency generator which has a control input connected to the battery and permitting control of the width of the pulses provided by the frequency generator as a function of battery voltage.

In accordance with a feature of the invention, the frequency generator is a voltage controlled oscillator (VCO) in which the control voltage is directly derived from the supply voltage to the ignition coil, for example the on-board battery network of an automotive vehicle. The battery voltage, thus, will directly affect the width of the pulses and/or the frequency of the frequency generator and can be connected to the control input of the variable frequency VCO.

The width of the pulses supplied by the variable frequency generator need not vary continuously over a given range; it may also vary in steps, in dependence on switching events. For example, the frequency generator may have two frequencies, selectively, at its output, so that the frequencies or, respectively, the pulse widths thereof, can be controlled in accordance with the position of a control switch. This control switch itself, can be controlled, or form part of the starter network so that, if the starter is operated, the frequency generator is automatically, simultaneously set to provide pulses of greater pulse width or, respectively, of lower frequency.

The ignition voltage then will be essentially independent of the supply voltage and, especially if the on-board network of a vehicle is highly loaded, for example upon operating the starter switch, resulting in particularly large drop of supply voltage. Proper ignition voltage can nevertheless be provided.

Drawings: illustrating an example:

Figure 1:
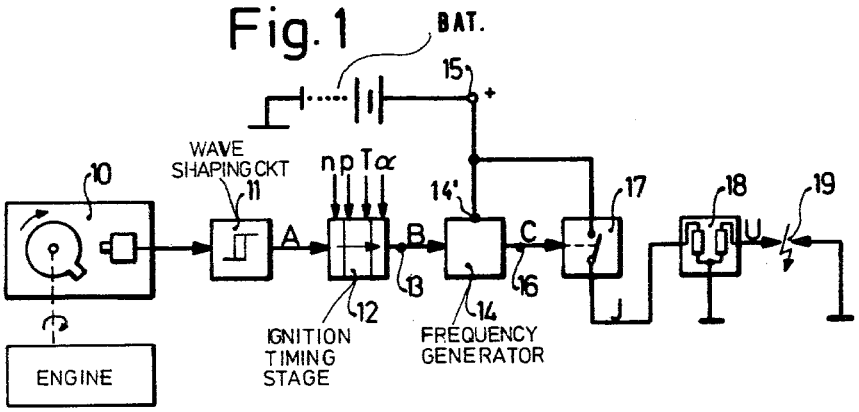
FIG. 1 shows, in schematic block diagram form, one embodiment of the invention.

A transducer 10, preferably coupled to the crankshaft of an internal combustion engine shown schematically only by block E (FIG. 1), is connected to a wave-shaping stage 11 which, in its simplest form, is a Schmitt trigger. The transducer 10 is illustrated in form of an inductive transducer, but other arrangements may be used, for example a breaker contact, a Hall generator, an opto-coupler, or the like. The output of the wave-shaping circuit 11 is connected through an ignition timing stage 12, having an output terminal 13, to a frequency generator 14. The ignition timing stage 12 is not strictly needed; it is, however, preferred to include the ignition timing stage in the system to shift the ignition signal in dependence on motor operating parameters, as illustrated speed n, induction pipe pressure or, rather, vacuum p, temperature T and throttle deflection position $\alpha$. The ignition timing stage need not be described in detail, and various types are known. The frequency generator provides a sequence of pulses, for each ignition event, available at output terminal 16 to a controlled switch 17 which, preferably, is a transistor. The elements 10 to 14 provide the control system for the switch 17. Terminal 15 is connected to a source of positive voltage, for example the battery of the on-board network of an automotive vehicle. Terminal 15 is connected through the switching path of the switch 17 to the primary of an ignition coil 18. The secondary of the ignition coil 18 is connected to the spark gap 19, typically the spark plug of the internal combustion engine. If more than one spark plug is used, for example for a multi-cylinder engine, the well-known distributor can be interposed between the coil 18 and the spark plugs 19. The second electrode of the spark plug 19, as well as the windings of the coil 18 are connected to ground or chassis.

In accordance with the present invention, the frequency generator 14 is a frequency generator which can provide pulses of variable pulse width, or pulses having a variable frequency, that is, variable pulse repetition rates, so that not only the pulse width but also the length of the pulse gaps changes. In accordance with a feature of the invention, the frequency generator 14 is a voltage controlled oscillator (VCO) which, for example, is available as a commercial article in integrated circuit form as RCA Type CD 4046.

The integrated circuit CD 4046 provides an output frequency, that is, a pulse duration which is approximately inversely representative of applied voltage. The control terminal 14' of the frequency generator 14 is connected to the terminal 15 forming the battery supply. This control terminal 14' changes the output frequency of the VCO. The output of the VCO 14 then is available at terminal 16.

Figure 2:
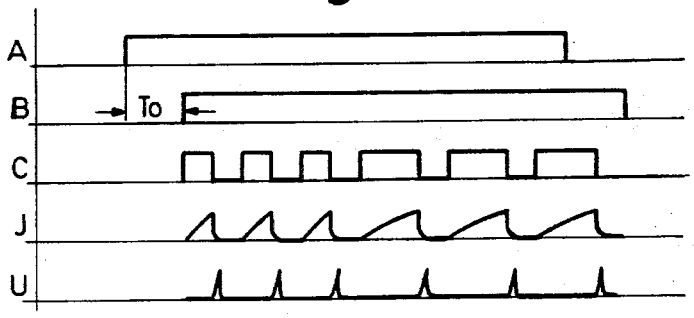
FIG. 2 shows, in a series of graphs, signals arising in the circuit of FIG. 1.

Operation, with reference to FIG. 2: Transducer 10 provides an output signal which is transformed in the wave-shaping circuit 11 into the signal shown at graph A of FIG. 2. FIG. 1 has been labelled with capital letters corresponding to the signals of FIG. 2 where they arise. The ignition timing stage 12 converts the signal of graph A into the signal of graph B by providing a timing shift To in accordance with the input parameters applied to the ignition timing stage to provide, respectively, for spark advance, spark delay, and the like, as required by the ignition timing operating characteristics of the engine. Ignition timing stage 12 is not necessary for simple systems and, in such cases, the signals A and B will coincide. The VCO of frequency generator 14 is controlled to provide output pulses during the duration of the signal B and its output will be a pulse train C. The wave shape and frequency of the pulse train of the VCO depend on the voltage applied to its control terminal 14', that is, on the voltage of terminal 15. If the voltage at terminal 15 drops, the frequency of the output signal train C will drop. The pulse duration will increase. This is illustrated in the diagram of graph C in the fourth, fifth and sixth pulses.

Switch 17 is closed when the signal C has a positive value. Current I can then flow through the primary winding of ignition 18 and will rise until, upon opening of switch 17 at the termination of the pulse, it drops suddenly. During this sudden drop, a high ignition voltage U is induced in the secondary of the coil 18 which results in an ignition spark. Upon drop of the supply voltage, current I will rise more slowly. As illustrated in connection with the fourth, fifth and sixth pulses in graph J, however, due to the increase of the pulse period, the current will reach the same final value which results in the same intensity of spark pulse at the secondary of coil 18 and hence across spark plug 19. Thus, uniformity of sequential ignition pulses applied to the spark plug 19 for any one ignition event is ensured.

Figure 3:
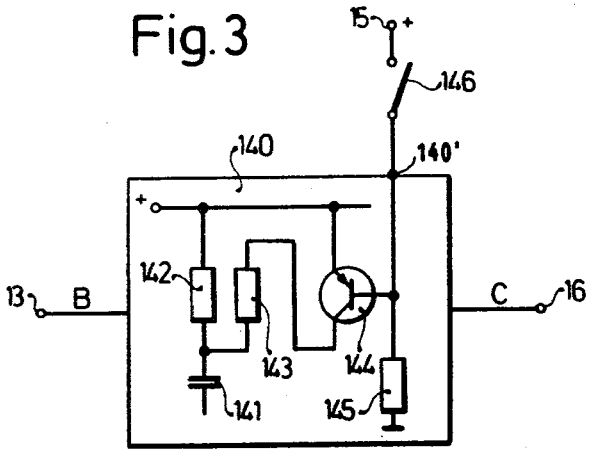
FIG. 3 is a fragmentary diagram of a frequency generator suitable for the system of FIG. 1, and illustrating another embodiment of the invention.

Referring to FIG. 3, illustrating a further embodiment: The system of FIG. 3 is identical to that of FIG. 1 except for the frequency generator 14, which is now replaced by element 140. As shown, the frequency generator 140 is connected between terminals 13 and 16 (FIG. 1). Frequency generator 140 can provide two fixed output frequencies. The element determining the frequency in a frequency generator 40 usually is a capacitor. Typical frequency generators are astable multivibrators including a frequency determining capacitor which is charged over a resistor and then discharged. As illustrated in FIG. 3, capacitor 141 is charged over resistor 142 and then discharged. Only the frequency determining components 141, 142 of the frequency generator 140 are illustrated in FIG. 2.

A further resistor 143 is connected in parallel to resistor 142. Resistor 143 is additionally connected to the switching path formed by the emitter-collector path of a transistor 144 which, in turn, is controlled by its base. The base of transistor 144 is connected through a resistor 145 to ground or chassis and, further, to control terminal 140' and then through a switch 146 to the supply terminal 15. The emitter of transistor 144, as well as resistor 142 are connected to a supply voltage which, preferably, is stabilized. Switch 146 preferably is the starter switch for the starter motor of the internal combustion engine. Upon starting of the engine, the supply voltage supplied by the battery drops substantially; yet, high requirements are placed on the ignition, particularly during cold outside temperatures, to ensure combustion of the air-fuel mixture drawn into the cylinder.

Operation: Let it be assumed that switch 146 is open. Transistor 144 will be conductive and charge and discharge of capacitor 141 is effected over the parallel connection of the two resistors 142, 143. Upon closing of switch 146, control terminal 140' has supply voltage applied and transistor 144 will block and charge and discharge of capacitor 141 will now occur only over resistor 142. As a consequence, the charge time of capacitor 141 will increase, that is, the time until the capacitor 141 reaches a predetermined voltage will increase. This decreases the frequency of the frequency generator 140 and the pulse duration is extended. The effect of pulse duration will, then, be similar as described in connection with the embodiment of FIG. 1.

The supply voltage to which the frequency determining elements 141, 142, 143 of the frequency generator 140 are connected may be the supply voltage. If this is a nonstabilized voltage, that is, if it is directly connected to the supply voltage, drop of the supply voltage will additionally increase the frequency of the output from the frequency generator 140, available at terminal 16 and forming the pulse train C.

Other frequency generators may be used, provided that the frequency and/or the pulse width thereof is controllable by a control signal; various other modifications and changes may be made within the scope of the inventive concept.

The elements 17, 18, 19, connected to the battery BAT and terminal 15 form a power supply circuit; the elements 10, 11, 12, and frequency generator 14 form a power connection timing control circuit which, together with the power supply circuit, forms an ignition power supply branch of the system. The branch line from the battery BAT and terminal 15 to the control terminal 14', 140', respectively, of the controllable frequency generator 14 forms a spark energy control branch of the system since it applies a signal representative of voltage level of the battery to the frequency generator 14, 140, to vary the duty cycle thereof in such a manner that the energy of anyone ignition spark will be essentially independent of battery voltage.

We claim:

1. Multiple spark ignition system for an internal combustion engine system for combination with a battery (BAT) supplying electrical energy to the ignition system said system comprising an ignition power supply branch connected to the battery (BAT) including an ignition coil (18);

at least one spark gap (19) connected to the secondary of the ignition coil;

a controlled switch (17) connected to the primary of the ignition coil (18) and controlling current flow from the battery thereto, means (10, 11, 12) providing a control pulse (B) to determine initiation of an ignition event;

a frequency generator (14, 140) controlled by the control pulse and providing an output pulse train to the controlled switch (17) for multiple closing operation of the switch as a function of the width of the pulses of the pulse train, and to cause multiple ignition pulses to be applied to the spark gap, said frequency generator (14, 140) being a pulse width controllable frequency generator providing output signals of varying pulse width and having a control input terminal (14', 140) controlling the width of the output pulses provided by said frequency generator;

and a spark energy control branch connected to the battery (BAT) including means deriving a signal representative of battery voltage, said sensed battery voltage signal being connected to the control input terminal (14' 140') of the frequency generator (14, 140) to control the width of the output pulses thereof in a sense to increase the width of the output pulses therefrom upon drop of battery voltage so that the energy supplied to the coil (18) by the battery, upon closing of said controlled switch (17) during occurrence of any one of said pulses, and to cause a single ignition pulse, will be essentially unaffected by drop of battery voltage.

2. System according to claim 1, wherein the frequency generator (14) is a voltage controlled oscillator.

3. System according to claim 2, wherein the voltage controlled oscillator (14) is connected to the battery (BAT) and controlled by the battery voltage.

4. System according to claim 1, for use with a starter motor connected to the engine system;

wherein said sensing means (146) includes the starter switch of the starter for the internal combustion engine system.

5. System according to claim 4, wherein the frequency generator (140) comprises a frequency determining capacitor-resistor network including a capacitor (141) and a resistor (142);

a further resistor (143) being connected in parallel through said frequency determining switch (144) with said first resistor (142), said sensing means controlling selectively connection of said further resistor (143) in circuit with said resistor-capacitor network.

6. System according to claim 5, for use with a starter motor connected to the engine;

wherein said sensing means (146) includes the starter switch of the starter for the internal combustion engine.

7. System according to claim 6, wherein the frequency generator (140) comprises a frequency determining capacitor-resistor network (141, 142) connected to the supply voltage of the system, the frequency of the frequency generator being determined by the charge rate of the capacitor-resistor network and dependent on the supply voltage to increase the charge time of the capacitor, and hence increase the pulse width of the output pulses provided by the frequency generator upon drop of supply voltage.

8. System according to claim 1, wherein the frequency generator (140) provides output pulses of dual pulse width;

a switch (144) is provided, selectively connecting the frequency generator to provide output pulses with either one, or the other pulse width;

and the sensing means (146) includes a switch which changes state with change of battery voltage to control operation of said switch (144) and hence control the pulse width of the output pulses from the frequency generator.

* * * * *